United States Patent [19]

Wehrli

[11] 4,154,458

[45] May 15, 1979

[54] SKI BRAKE

[75] Inventor: Hans Wehrli, Rapperswil, Switzerland

[73] Assignee: Hans Wehrli, Kunstharzpresserei, Switzerland

[21] Appl. No.: 853,827

[22] Filed: Nov. 21, 1977

[30] Foreign Application Priority Data

Nov. 25, 1976 [CH] Switzerland ..... 014961/76

[51] Int. Cl.[2] ..... A63C 7/10

[52] U.S. Cl. ..... 280/605; 280/634

[58] Field of Search ..... 280/605, 604, 633, 634; 188/5

[56] References Cited

U.S. PATENT DOCUMENTS

| | | | |
|---|---|---|---|
| 1,345,988 | 7/1970 | Brager et al. | 280/605 |
| 3,930,659 | 1/1976 | Salomon | 280/605 |
| 3,940,158 | 2/1976 | Wehrli | 280/605 |
| 3,989,271 | 11/1976 | Riedel | 280/605 |

*Primary Examiner*—David M. Mitchell

*Attorney, Agent, or Firm*—Roylance, Abrams, Berdo & Farley

[57] ABSTRACT

Disclosed is a ski brake of the type fixed to the upper surface of a ski. The brake includes a pair of brake shoes on opposite sides of the ski biased into a downward, active braking position, and a counter biasing pedal which holds the brake in an inactive position when held down by a ski boot. The pedal is a U-shaped loop formed by a pair of arms of unequal length and with separate pivot points longitudinally displaced on the ski, so that elastic deformation of the loop when it is pivoted gives rise to a return bias into the braking position. At the U connection between the arms there is provided an adjusting member in the form of a turnbuckle which permits the spacing between the arms to be adjusted to suit the particular width of the ski.

4 Claims, 2 Drawing Figures

SKI BRAKE

BACKGROUND OF THE INVENTION

The invention relates to a ski brake which is fixed to the top of a ski and has at least one pivotably mounted brake shoe arranged along the lateral edge of the ski. The brake shoe is provided with a holding loop, by means of which it can be pivoted for travel into an inactive rest position which is at least approximately parallel to the top of the ski.

Various ski brake constructions are known. According to a first construction, the ski brake essentially comprises a double-armed spring-biased lever pivoted on the top of the ski. One arm is constructed as a brake blade, while the other arm is constructed in such a way that it serves as a counter-biasing holding loop and is pressed down horizontally by the ski boot when the latter is inserted in the ski binding, whereby the brake blade is pivoted into an inactive sprung travel position in which it is substantially parallel to the top surface of the ski. On removal of the ski boot from the ski binding, the transfer from the travel position of the ski brake into the active braking position is effected by spring tension.

In another known ski brake construction (U.S. Pat. No. 3,083,028), the ski brake comprises two independent parts, each having a brake blade. Thus, a separate holding loop is provided for each brake blade. In the case of this construction, it is easily possible to adapt the ski brake to a particular ski width.

In another known construction (U.S. Pat. No. 3,940,158), the holding loop is shaped from a single spring wire, whose ends are constructed as spaced, juxtaposed shafts pivoted on the top of the ski. On passing from the braking position into the travel position, the holding loop is resiliently deformed, and as a result of its deformation produces a spring tension through which the brake blade or blades fixed to the shaft or shafts are pivoted into the braking position on removal of the ski boot from the ski binding. Thus, in the case of ski brakes of this type, it is not possible to adapt to the width of the ski.

An object of the invention is therefore to so construct a ski brake of the type described above so that it can be easily adapted to the width of the ski.

SUMMARY OF THE INVENTION

According to the present invention, the holding loop of a ski brake has two arms whose free ends are interconnected by an adjusting member and which are displaceable at right angles to the longitudinal direction of the ski.

DESCRIPTION OF THE PREFERRED EMBODIMENTS

Figure 1:
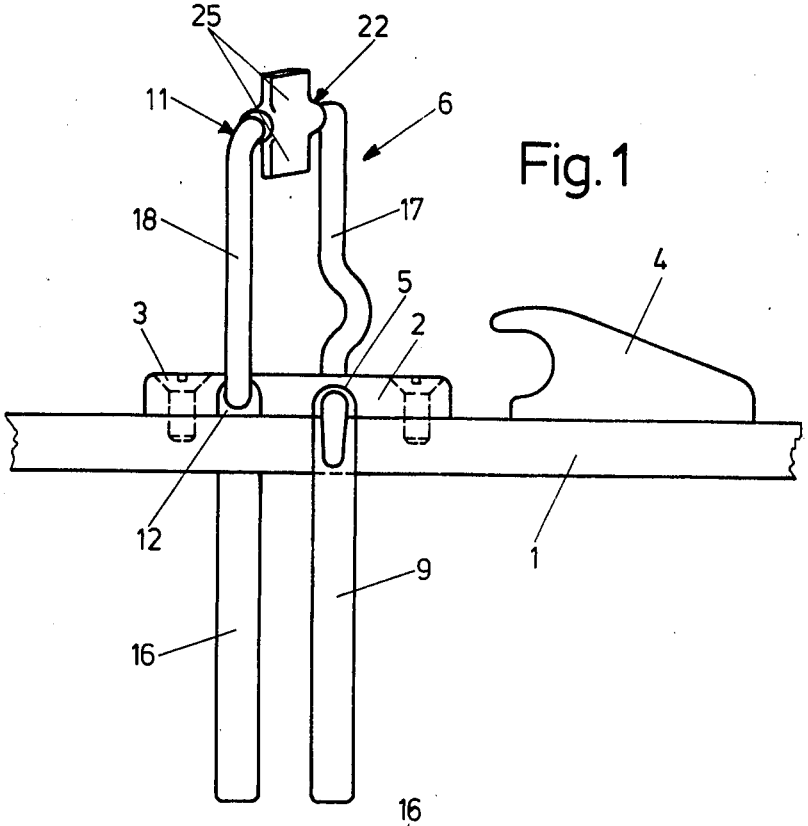
FIG. 1 is a side view of a ski brake in accordance with a preferred embodiment of the present invention, fitted to a ski and in the braking position.
Figure 2:
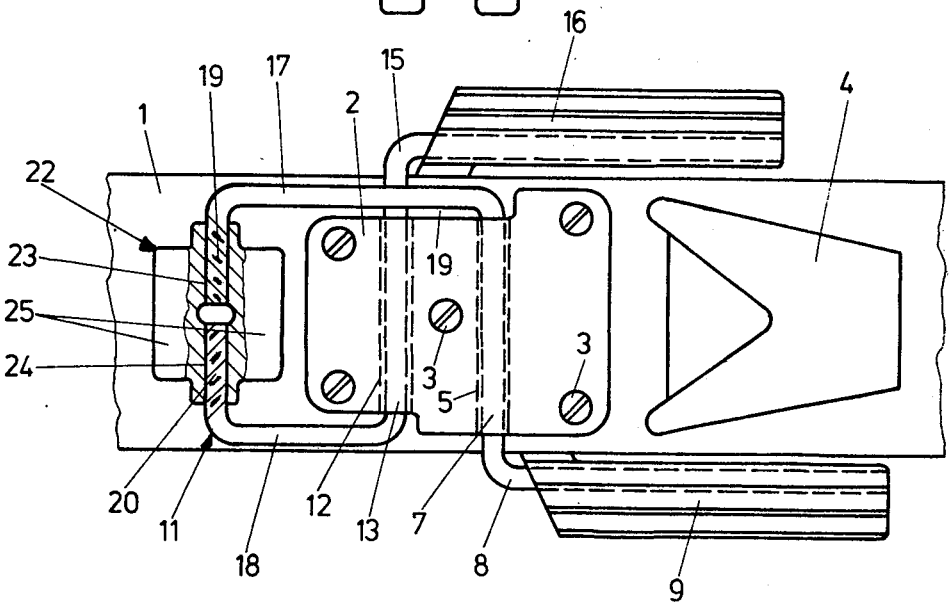
FIG. 2 is a top view of the ski brake of FIG. 1, in the travel position.

Ski 1, which is only partly shown in FIGS. 1 and 2, carries on its top surface a holding plate 2 which is fixed to the top of the ski by screws 3. Holding plate 2 is arranged in the vicinity of any desired holding piece, such as for example a heel holding piece of a safety ski binding. The holding plate 2 has on its bottom a first recess 5 which extends in the form of a slot at right angles to the longitudinal axis of the ski end on the top thereof. In recess 5 is pivoted a wire rod 6, whose central portion 7 forms a pivot shaft. A brake shoe 9, made for example of plastic material, is fixed to one end portion 8 of the wire rod 6.

FIG. 2 shows that the central portion of the wire rod 6 is constructed as a counter-biasing holding loop 11 which is pressed onto the top of the ski by the ski boot in the skiing or travel position, and thereby simultaneously pivots the brake shoe 9 into its inactive travel position above the tread of the ski 1.

The other end portion 15 of the wire rod 6 forms a second shaft 13 pivoted in a recess 12 of the holding plate 2. Thus, the holding loop 11 is pivoted on both shafts 7 and 13. The axes of both recesses 5 and 12 are spaced from, and substantially parallel to, one another. As a result, the wire rod 6 is elastically pre-stressed when in the skiing position.

A further brake shoe 16 is fixed to end 15 of the wire rod 6. However, only one brake shoe may be provided.

Since the wire rod 6 is elastically pre-stressed, due to the staggered position of the two shafts 7, 13, the brake shoes 9, 16 are automatically pivoted into the braking position and held there when the holding loop 11 is released.

It is important that the holding loop 11 is sub-divided into two arms 17, 18, whose ends 19, 20 are threaded. One thread is constructed as a left-hand thread, and the other as a right-hand thread. The two ends 19, 20 are interconnected by a turnbuckle adjusting member 22, which has two tapped holes 23, 24 having a right or left-hand thread corresponding to the threads of ends 19, 20. Adjusting member 22 can be constructed substantially as a sleeve. If, as shown in FIGS. 1 and 2, it is additionally provided with extensions 25, the adjusting member 22 forms a pedal member which facilitates the pressing down of the holding loop 11 by the ski boot.

Adjusting member 22 constructed as a pedal member can, as shown in FIG. 2, be constructed as a metal part, but it is also possible to use another suitable material, such as a plastic material. Thus, the pedal member fulfills three functions. Firstly, the rotation of the pedal member provides a turnbuckle adjustment for the spacing of arms 17, 18. Consequently, the position of the brake shoe or shoes 9, 16 is thereby adapted to the ski width. Secondly, it ensures the bracing of the holding loop 11. Thirdly, it prevents the loop 11 from catching on the sole of the ski boot.

While a certain advantageous embodiment has been chosen to illustrate the invention, it will be understood by those skilled in the art that various changes and modifications can be made therein without departing from the scope of the invention as defined in the appended claims.

I claim:

1. A ski brake of the type fixed to the upper surface of a ski comprising a pair of brake shoes arranged on opposite sides and along the lateral edges of the ski, spring bias means for pivoting said brake shoes from an inactive travel position, in which position said brake shoes are substantially parallel to the top surface of the ski, to an active braking position, in which said brake shoes extend down beyond the bottom surface of the ski, and a counter-biasing lever for selectively holding said spring bias means in a tensioned position with said brake shoes in their inactive position, said counter-biasing lever including a pair of spaced arms, one end of each of said arms connected to one of said brake shoes so that said brake shoes may be pivoted by said arms between said inactive and active positions, a transverse end extending from the other end of each of said arms, and an adjusting member transversely connecting together said transverse ends and permitting adjustment of the spacing between said arms, said adjusting member and said transverse ends having mating threads which cooperate so that said adjusting member connects to said arms as a turnbuckle substantially transverse to said arms.

2. A ski brake according to claim 1, wherein said arms are of unequal lengths and pivot at points longitudinally displaced in the top of the ski, whereby elastic deformation of said arms when pivoted provides said spring bias means.

3. A ski brake according to claim 1, wherein said adjusting member is provided with an extension member extending laterally therefrom.

4. A ski brake according to claim 1, wherein the adjusting member is made from a plastic material.

* * * * *